United States Patent [19]

Eckold et al.

[11] Patent Number: 4,658,502

[45] Date of Patent: Apr. 21, 1987

[54] SHEET METAL JOINING APPARATUS

[76] Inventors: Gerd-Jürgen Eckold, Silberhutte 11, 3424 St. Andreasberg; Hans Maass, Germelmannstr. 12, 3422 Bad Lauterberg, both of Fed. Rep. of Germany

[21] Appl. No.: 713,677

[22] Filed: Mar. 19, 1985

[30] Foreign Application Priority Data

Mar. 22, 1984 [DE] Fed. Rep. of Germany ... 8408792[U]
Mar. 22, 1984 [DE] Fed. Rep. of Germany ... 8408793[U]

[51] Int. Cl.[4] ..... B23P 19/00

[52] U.S. Cl. ..... 29/798; 29/21.1; 29/432.1; 29/509; 29/522 R; 403/283

[58] Field of Search ..... 29/432, 432.1, 798, 29/21.1, 243.52, 509, 522 R, 513; 403/283

[56] References Cited

U.S. PATENT DOCUMENTS

| | | | |
|---|---|---|---|
| 2,288,308 | 6/1942 | Williams . | |
| 2,671,361 | 3/1954 | Sandberg . | |
| 2,688,890 | 9/1954 | Williams . | |
| 2,924,312 | 2/1960 | Williams . | |
| 3,130,489 | 4/1964 | Schlage | 29/522 R X |
| 3,276,112 | 10/1966 | Tantlinger et al. . | |
| 3,359,935 | 12/1967 | Rosbottom | 29/522 R X |
| 3,579,809 | 5/1971 | Wolf . | |
| 3,726,000 | 4/1973 | Hafner . | |
| 3,729,804 | 3/1973 | Middleton . | |
| 3,771,216 | 11/1973 | Johnson | 29/522 R X |
| 3,828,421 | 8/1974 | Erlichman . | |
| 3,919,955 | 11/1975 | DuVernay . | |
| 4,130,922 | 12/1978 | Koett . | |
| 4,208,776 | 6/1960 | Schleicher . | |
| 4,306,511 | 12/1981 | Ashby et al. | 29/532 X |
| 4,459,735 | 7/1984 | Sawdon . | |

*Primary Examiner*—Charlie T. Moon
*Attorney, Agent, or Firm*—Cushman, Darby & Cushman

[57] ABSTRACT

A method and apparatus for joining two adjacent sheets of metal the complementary engaging of a male die and a female die, during one stroke, only one of the two sheets is provided with incisions and the material of the other sheet is pressed through the area defined along the incisions and is extruded laterally beyond the edges thereof to form a rivet-type connection.

14 Claims, 11 Drawing Figures

SHEET METAL JOINING APPARATUS

FIELD OF THE INVENTION

The present invention relates to a joining method in which two adjacent sheet metal pieces are joined together. The invention also relates to an apparatus adapted to implement the joining method and to the resulting joint formed in the two sheets.

BACKGROUND OF THE PRESENT INVENTION

European Pat. No. EP-B-00 77 932, which corresponds to my co-pending U.S. patent application Ser. No. 438,095, now abandoned, discloses apparatus for joining two sheets of metal which lie in a side-by-side relationship. The apparatus comprises a female die having a central anvil member and support members adjacent that anvil member that extend beyond the anvil working face. The apparatus also includes a male die, which is movable relative to the female die, that will move through the two sheets of metal in a direction toward the anvil member's working face. The support members adjacent the anvil have cutting edges at there distal ends and may flex resiliently outwards with respect to the anvil member to accommodate expansion of metal between the anvil and the male die.

In use, the male and female dies cooperate such that both sheets are cut along congruent incisions, with the male die pressing against the anvil member working surface of the female die. The material is deformed so that sheet metal is laterally extruded to engage beyond the edges of the incisions opposite the sheet metal first pierced by the male die. For this purpose the male die or each of the male dies, if there are a plurality of male dies and female dies, has a cutting edge so that the sheet metal piece first engaged by the male die is properly cut as well as the other sheet metal adjacent the female die.

Joints made by means of this known apparatus, in general, have a strength sufficient for most practical applications. However, in some cases extreme joint strength is required which cannot be reached by using the above method and apparatus.

Another joining method and apparatus to produce a joint wherein the joint remains fluid-tight is disclosed in DE-A-31 06 313. According to the teaching of this publication, two sheet metal pieces are joined in a side-by-side relationship by an apparatus having a male die and a female die but where neither die has cutting edges. The result is that no incisions are produced and neither sheet is cut in any way. Instead, both sheets are merely bulged and deformed, one within the other within the joint site, so that material of both sheet metals protrudes to one side. Thereafter, both protruding material portions are laterally compressed to form the final joint structure. For this purpose the female die may laterally open against spring bias. It should be noted that the deformed portion of the sheet adjacent the female die does not contribute to the strength of the joint; on the contrary, it withstands the lateral deformation of the other sheet metal portion so that the joint strength obtained is limited. Moreover, all interengaging surfaces of the two sheet metals are rounded, which further limits joint strength. These considerations, again refer to joints produced with identical materials and when the joints are of comparable size.

Accordingly, it is the object of the present invention to provide a method and apparatus by which joints of this desired increased strength may be produced. "Increased strength", in this context, means higher strength as compared with the strength of joints made by use of the apparatus referred to above, under circumstances which otherwise are the same (i.e. where thickness and the type of the sheet metals being joined are the same, and there is a similar size joint).

SUMMARY OF THE PRESENT INVENTION

According to the present invention only one of the sheets is in anyway cut. Thus, only the sheet directly adjacent the female die is cut or provided with incisions. Material of the upper sheet that remains uncut is deformed by the male die during the pressing phase and is laterally extruded so that it flows beyond the edges of the incisions in the lower sheet. Since material from the upper sheet in the joint area is only deformed and passed through the incisions made in the lower sheet the upper sheet remains uncut, and integrally formed.

Surprisingly, it has been found that joints produced by this method and apparatus have a strength exceeding that of the known joints initially referred to above by at least 50% and, in some cases (e.g. shearing strength) by 75%.

As a further advantage it should be noted that the non-cut sheet metal remains fluid-tight, a fact which in some applications is of utmost importance. Frequently, the sheet metals will have a coating for purposes of providing corrosion protection, and if such coating (for example zinc plating on steel) is plastically deforable, such a coating on the non-cut sheet will remain in tact allowing joints of this type to be used in applications and situations not heretofor possible where a strong joint is desired.

A particularly simple embodiment of the apparatus according to the present invention comprises a female die having only two support members, each having a cutting edge, the cutting edges of the two support members being parallel to each other. This embodiment is not only simple in manufacture but also easy to adjust on a press because the alignment of male and female die must be effected only in direction perpendicular to the cutting edges, while the alignment in the direction orthogonal thereto is uncritical.

The embodiments of the apparatus according to the present invention together with other objects and characteristics of the present invention will become more apparent upon consideration of the following description and the appended claims with reference to the accompanying drawings. These drawings are simplified in an attempt to illustrate only the features of importance for the implementation of the invention and the disclosure of our U.S. patent application Ser. No. 438,095 which corresponds and to European Pat. No. 00 77 932, is included herewith by reference. The description, claims and drawings all form apart of this specification, wherein like reference numerals designate corresponding parts in the various Figures.

DETAILED DESCRIPTION OF THE PREFERRED EMBODIMENT OF THE PRESENT INVENTION

Figure 1:
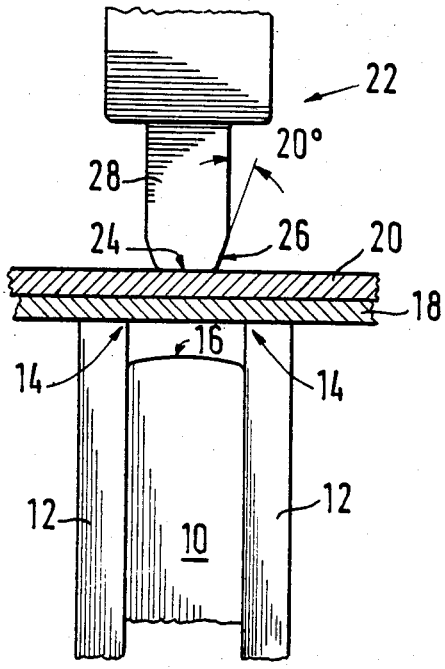
FIG. 1 is a diagrammatic partial side elevational view of a first embodiment, with the two sheet metal pieces to be joined being shown in section.

The press on which the co-operating tool parts, i.e. male die and female die, are mounted and aligned relative to each other, is not shown in the drawings. The operating direction of the press, however, is clearly seen from the combination of FIGS. 1 and 2 which show the two possible relative positions of male and female dies at the beginning and at the end of the press stroke, respectively.

Figure 2:
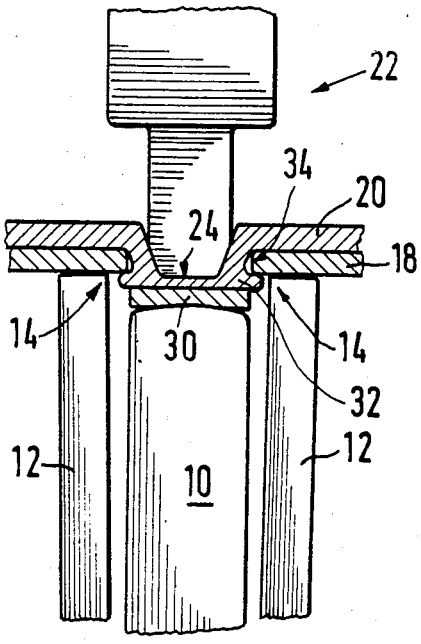
FIG. 2 shows in similar manner the elements after termination of the joining stroke.
Figure 3:
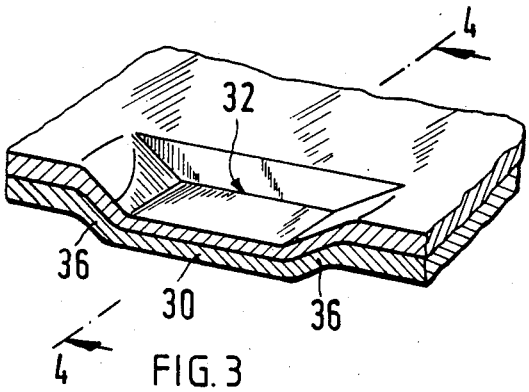
FIG. 3 illustrates in an isometric view, partially in section, a joint according to the invention as produced by the apparatus shown in FIGS. 1 and 2.
Figure 4:
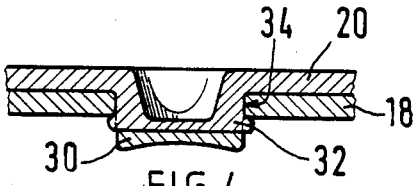
FIG. 4 is an illustration similar to FIG. 3 but seen in the direction of line 4—4 of FIG. 3.
Figure 5:
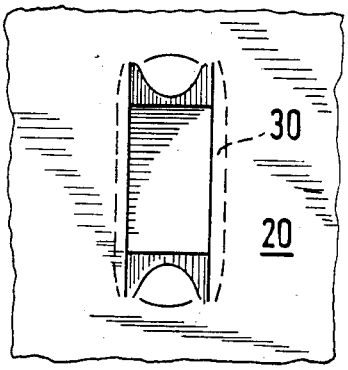
FIG. 5 is a top plan view on the joint of FIGS. 3 and 4.

Turning first to FIGS. 1 through 5, the female die is comprised a stationary anvil member 10 supported at its bottom in a conventional press and in a conventional manner. The anvil member 10 has a substantially rectangular ellongated section shape. FIG. 1 shows a side view from the narrower side. Support members 12 extend along each of the larger sides of anvil member 10, and are mounted so as to resiliently yieldable sidewards (cf. FIG. 2), to accommodate the expansion of metal therebetween. Support members 12 are shown in FIG. 2 being spread apart for the material in upper sheet 20. The free edges of support members 12 adjacent anvil member 10 act as cutting edges 14 to form and define the cut portion when the male die is lowered to effect incisions in the lower sheet 18 as shown in FIGS. 2 and 4. The plane defined by the two cutting edges is somewhat elevated with respect to the slightly convex shaped working face 16 of the anvil member 10, this elevation being smaller than the sum of the thicknesses of the two sheet metal pieces 18, 20 but the elevation exceeds the thickness of sheet 18 adjacent the female die.

The male die 22 has a working surface 24 which, as illustrated in FIG. 1, is narrower than the distance between the cutting edges of the two support members 12 of the female die. Moving rearward away from working surface 24 in an axial direction, the male die section tapers outwardly from that working surface so that the die-portion which permeates into the sheets has a truncated-pyramidal shape with a rectangularly shaped base. The pyramide sides are inclined with respect to the male die-axes by about 20°, thereby corresponding to an apex angle of about 40°. The difference between the width of male die working surface 24 and the distance spacing the two cutting edges on support members 12 from each other depends upon the thickness of the sheets, in particular upon the thickness of the sheet 20, and preferably is dimensioned such that sheet 20, the upper sheet, is not cut during the joining operation. The edge surrounding working surface 24 is rounded and in the illustrated embodiment the rounding radius is in the order of magnitude of 0.5 mm and following such rounding that radius is polished. These side faces of the truncated-pyramidal die portion are designated at 26. While the contour of the male die at the sides extending orthogonally to the cutting edges of the female die is not illustrated in FIGS. 1 and 2, it is, however, seen in FIG. 9 which shows a male die comprising two die members similar to the male die of FIG. 1 and 2. It is to be noted that here again the contour has about the same apex angle of the pyramide as the other sides extending parallel to the cutting edges.

While FIG. 1 shows the situation prior to the joining of sheets 18 and 20, FIG. 2 illustrates the results of the press stroke. It is to be noted that the press is adjusted either in terms of the pressure applied or with respect to its stroke.

In FIG. 2, sheet 18 is cut along parallel cutting edges 14 which extend orthogonally to the plane of the drawing. Such cutting occurs due to the cooperation of these cutting edges 14 with the male die 22, and the cut sheet portion 30 of sheet 18 is deformed between the incisions through to the working face 16 of the anvil member. Upon further pressure (and thus further stroke) from the male die 22, the deformed portion 32 of upper sheet 20, which was not cut, is extruded laterally such that its material is plastically deformed beyond the edges 34 which lie on sheet 18. These edges are formed by the cutting of portion 30 and movement of portion 30 below edges 34. These edges also will ridgidly engage that portion of sheet 20 extruded between edges 34 and portion 30. Portion 30 remains connected at its ends 36 to sheet 18, as shown in FIG. 3, because there was no cutting operation that took place due to the use of only the two side support members 12. The joint so produced is illustrated in detail in FIGS. 3 to 5.

In the first embodiment described above there were only two substantially parallel incisions in sheet 18. Accordingly, the female and male dies for this purpose have a very simple but effective design that can be manufactured at low cost.

Figure 8:
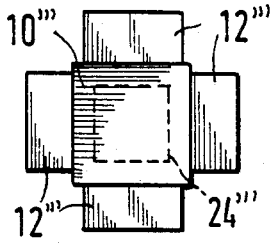
FIGS. 6, 7 and 8 show top plan views of further embodiments of the female die as may be used in the apparatus.
Figure 6:
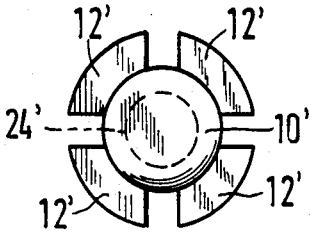
Figure 7:
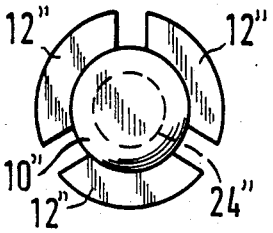

If particular design considerations are to be met with regard to the appearance of the joints, for example if the joints are to be visible in household appliances, an embodiment of the apparatus according to the present invention may be preferred as illustrated in FIGS. 6 to 8. These embodiments are shown only as plan views on the female die. The anvil member 10′ (FIG. 6) and 10″ (FIG. 7) is cylindrical, and the corresponding support members 12′ and 12″ respectively have spaced apart portions that define spaced apart cutting edges which cut into the adjacent sheet only along four (FIG. 6) or three (FIG. 7) accurate portions which have the same radius and a common centre. Between the incisions there is always an uncut connection performing the same function as the uncut connections 36 in FIG. 3. The working surface of the respective male die is indicated in dashed lines shown at 24′ and 24″ respectively; the contour of these male dies will then be in the form of truncated cones with an apex angle of preferably about 40°, analogue to FIG. 1.

In the embodiment of FIG. 8, there are four separate support members 12‴ disposed about an anvil member 10‴ having a square sectional shape as shown. The connection portions will then be provided in the corners.

It is to be noted that under certain circumstances the connecting portions of the various embodiments may also be servered. This would mean in FIGS. 6 and 7 a closed circular incision and in FIG. 8 a closed square incision, with the result that a small plate portion would be completely stamped from the lower sheet adjacent the female die having the respective contour. The appearance of the joint will then be very similar to a rivet head, and, after each joining operation, the stamped out plate portion would have to be ejected from the female die.

Figure 9:
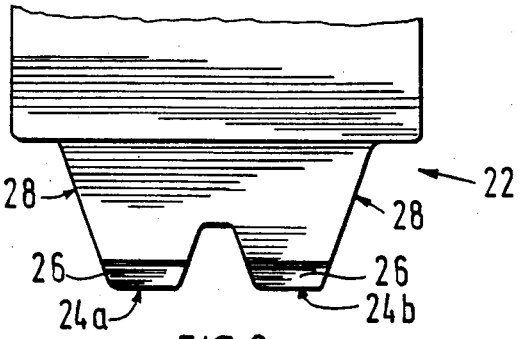
FIG. 9 is a side elevational view of a further embodiment of a male die.

The male die according to FIG. 9 is a twin die in that two male dies according to that shown is FIG. 1 are disposed side-aside and are manufactured as an intregal one piece. One will see the two working faces 24*a*, 24*b* and the respectively allocated side walls 28 extending orthogonal to the cutting edges of the female die (not shown) and that they also define an apex angle of 40°. The cutting edges of the respective female die are similar to FIG. 1 but somewhat longer so that with only one press stroke two juxtaposed joints are produced.

Figure 10:
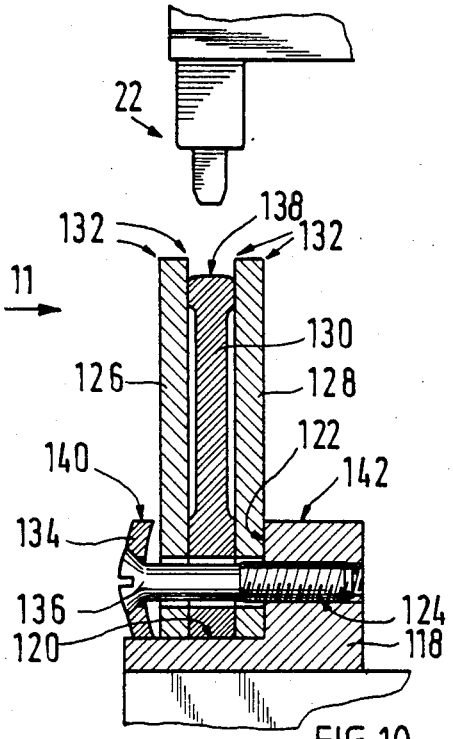
FIG. 10 is a diagrammatic side elevational view, partially in section, of another embodiment of the present invention.
Figure 11:
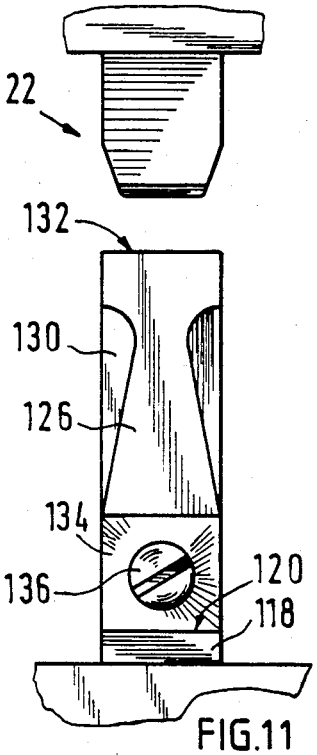
FIG. 11 is a view along line 11—11 in FIG. 10.

FIGS. 10 and 11 show a female die in which the support members are replacable.

The female die comprises a socket, indicated at 118, having a flat or planar bottom 120 which extends parallel to the table of a press (not shown) and a flat clamping surface 122 which extends orthogonally top to bottom 120. A threaded hole 124 extends horizontally into socket 118 from the clamping surface 122.

Support members 126, 128 and anvil member 130 are separately produced components. Anvil member 130 is a stamped steel part while the support members are cut off from springy steel and each has two cutting edges 132, one on each side thereof, with respect to the anvil member 138. In the area of the cutting edges the support members are hardened or hard-coated and ground. Anvil member 138 and support members 126, 128 have through-holes provided adjacent their bottom ends which when assembled will align together and with the threaded bore 124. The forces acting upon these components during the joining operation will be transmitted to socket 118 because the support members 126, 128 and the anvil member 138 all rest on and are supported by the bottom face 120.

On the side of the support member 126 facing away from clamping surface 122 there is a clamping disc 134 which also has a through-hole that will align with bore 124. The entire assembly is clamped by means of a screw 136 that will fit through the apertures in disc 134, in support elements 126, 128, and in anvil 138 and then be securable in threaded bore 124.

FIG. 10 illustrates the situation prior to the final fastening of screw 136 so that it may be seen that the disc 134 is still outwardly bulged so to act as a resilient disc. Its lower edge also abuts the bottom face 120.

This embodiment has the advantage that after the cutting edges on support members 126, 128 have been cut, one or both may be turned outside-in, and when the second cutting edge has become worn out may be completely replaced. Moreover, the anvil member may be also exchanged. Such an exchange will most probably not become necessary due to anvil wear. However, another anvil member would permit the joining of sheet metals having different thickness which also means a different spacing between cutting edges 132 and anvil working face 138.

The upper edge 140 of the disc is disposed on the same level as the upper edge 142 of clamping surface 122 so that there are identical clamping conditions for both support members.

As may be seen from FIG. 11 the support members have laterally cut off contours or shaped side so that the bending tension during the lateral yielding is distributed in uniform manner over the length of the support members.

While the invention has been described in connection with what is presently considered to be the most practical and preferred embodiments, it is to be understood that the invention is not to be limited to the disclosed embodiments but on the contrary, is intended to cover various modifications and equivalent arrangements included within the spirit and scope of the appended claims, which scope is to be accorded the broadest interpretation so as to encompass all such modifications and equivalent structures.

What we claim is:

1. An apparatus for joining two adjacent sheet metal pieces comprising a female die having a central anvil member provided with a working face and support members adjacent said anvil member, each support member projecting beyond a working surface of said anvil member and having cutting edges at the ends of said projections, said support members being adapted to flex away from said anvil member, and a male die having a working surface opposite said anvil working face, said male die working surface having width dimensions less than the distance at which said support member cutting edges are spaced apart, said male die being adapted to be moved and pressed toward said anvil working face whereby when two adjacent sheet metal pieces are positioned between said male and female dies and said male die is moved and pressed toward said anvil working face, the first sheet metal piece, adjacent said male die, is deformed but not cut and the second sheet metal piece, adjacent said anvil working face, is deformed and cut by said cutting edges, the deformation of said first sheet causing a swagging of the material thereof beyond the cut portions of said second sheet so as to join the two sheet metal pieces.

2. An apparatus as set forth in claim 1 wherein said male die tapers outwardly from its working surface.

3. An apparatus as set forth in claim 2 said male die is of rectangular cross section and has a truncated-pyramidal shape.

4. An apparatus as set forth in claim 2 wherein said male die is of circular cross section and has a truncated-conical shape.

5. An apparatus as set forth in claim 2 wherein said male die has tapering surfaces defining an apex angle of about 40°.

6. An apparatus as set forth in claim 2 wherein said male die working surface has rounded contour edges.

7. An apparatus as set forth in claim 6 for joining sheet metal pieces having a thickness of up to 2 mm and wherein said contour edges are rounded with a radius of about 0.5 mm.

8. An apparatus as set forth in claim 1 wherein said support members have straight cutting edges.

9. An apparatus as in claim 1 wherein including two pairs of support members wherein the cutting edges of said pairs are parallel to each other.

10. An apparatus as set forth in claim 8 having only two support members.

11. An apparatus as set forth in claim 10 wherein said anvil member and said two support members are resiliently mounted on a common carrier.

12. An apparatus as set forth in claim 1 wherein said support members have cutting edges disposed on a common circle.

13. An apparatus as set forth in claim 12 wherein adjacent cutting edges of juxtaposed support members are spaced from each other.

14. An apparatus as set forth in claim 8 wherein four support members are provided having their cutting edges disposed along a common square.

* * * * *